US005379888A

United States Patent [19]

Rentos

[11] Patent Number: 5,379,888

[45] Date of Patent: Jan. 10, 1995

[54] SEW FREE BUTTON ASSEMBLY

[76] Inventor: Margaret A. Rentos, 6201 Henryk Woods Rd., Cicero, N.Y. 13039

[21] Appl. No.: 188,896

[22] Filed: Jan. 31, 1994

[51] Int. Cl.[6] ..... A44B 1/18; A44B 7/00; B65D 85/24

[52] U.S. Cl. ..... 206/265; 24/90 HA; 24/304; 206/345; 206/348; 206/460; 428/99

[58] Field of Search ..... 2/265, 266, 115; 24/90 HA, 693, DIG. 11, 304; 206/348, 345, 338, 820, 460; 428/99, 137

[56] References Cited

U.S. PATENT DOCUMENTS

| | | | |
|---|---|---|---|
| 2,005,879 | 6/1935 | Albright | 206/460 X |
| 2,462,816 | 2/1949 | Schner, Jr. et al. | 206/820 X |
| 2,524,842 | 2/1949 | Slamon et al. | 24/90 HA X |
| 2,671,219 | 3/1954 | Levi | 2/265 X |
| 2,673,351 | 3/1954 | Host | 206/345 X |
| 3,023,422 | 3/1962 | Shular | 428/99 |
| 3,181,219 | 5/1965 | Deshaies | 24/304 |
| 4,705,167 | 11/1987 | Nakamura | 206/348 |
| 5,048,160 | 9/1991 | Goodrich et al. | 24/90 HA X |

FOREIGN PATENT DOCUMENTS

| | | | |
|---|---|---|---|
| 140152 | 10/1949 | Australia | 206/348 |
| 220897 | 4/1910 | Germany | 2/265 |
| 807284 | 1/1959 | United Kingdom | 206/348 |
| 887454 | 1/1962 | United Kingdom | 2/265 |

*Primary Examiner*—Bryon P. Gehman

*Attorney, Agent, or Firm*—Harris Beach & Wilcox

[57] ABSTRACT

A sew free replacement button unit in which at least one button is attached to the top side of a fabric section having an adhesive underside. A releasable backing sheet is applied to the adhesive underside of the fabric section and the button is sewn to both the fabric section and the backing sheet.

8 Claims, 3 Drawing Sheets

SEW FREE BUTTON ASSEMBLY

BACKGROUND OF THE INVENTION

This invention relates to a sew free button assembly for the temporary replacement of missing buttons on garments or for use as a closure device on a throw away garment such as a hospital gown or the like.

Articles of clothing such as mens dress shirts which are repeatedly worn and rewashed, are susceptible to considerable wear over their usable lifetime. As a consequence, the threads holding buttons to the garment fabric become weakened and oftentimes break whereupon the button is released from the garment. On these occasions, the wearer typically does not have time to make permanent repairs and either must replace the garment or in extreme cases, wear the garment with a missing button.

Buttons have been devised for temporarily replacing missing buttons, however, these devices have proven for the most part to be less than satisfactory. Typically, these prior art replacement buttons are supported upon a rigid standard that terminates in a point. The pointed end of the standard is driven through the garment at the button site and the penetrating end of the standard thereof grasped by a rather bulky releasable clamp.

The hole left by the button standard weakens the fabric and makes the sewing of replacement buttons difficult in that the thread tends to pull through the standard hole when stressed. The replacement button is expensive to manufacture and material costs are relatively high thus making its use economically questionable. Lastly, this type of replacement button can be damaged or damage the garment to which it is secured in the event the garment is passed through an automatic washing machine with the button still attached.

SUMMARY OF THE INVENTION

It is therefore an object of the present invention to improve temporary replacement button for use in association with wearing apparel.

A further object of the present invention is to provide an inexpensive temporary replacement button that can be quickly and efficiently applied to a garment.

A still further object of the present invention is to provide a temporary replacement button for use in association with a garment that will not harm the garment fabric.

Another object of the present invention is to provide a temporary replacement button that will remain attached to the garment for a number of washings and will not harm the garment.

Yet another object of the present invention is to provide a relatively inexpensive button assembly that can be used in association with a throwaway garment.

These and other objects of the present invention are attained by a button assembly that includes at least one fabric section having two sided adhesive tape applied to its back face. A releasable backing sheet is applied to the tape and a button is sewn onto the front face of the fabric with the stitching penetrating both the fabric section and the backing sheet. The stitching is arranged to tear away from the backing sheet when the sheet is removed from the fabric section.

In a further embodiment of the invention, a plurality of buttons are sewn in spaced apart alignment to a single fabric section and the fabric section is then adhesively secured to a throw away garment in registration with the button hole pattern of the garment.

BRIEF DESCRIPTION OF THE DRAWINGS

For a better understanding of these and other objects of the invention, reference will be made to the following detailed description of the invention which is to be read in association with the accompanying drawing, wherein.

DESCRIPTION OF THE INVENTION

Figure 1:
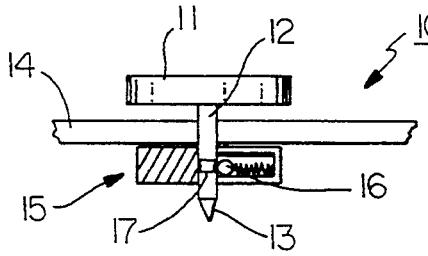
FIG.1 Prior Art
FIG. 1 is a side elevation in partial section showing a prior art replacement button.

Referring initially to FIG. 1, there is illustrated a typical replacement button unit 10, found in the prior art. The unit includes a button 11 that is secured to the proximal end of a metal rod 12 by any suitable means. The distal end of the rod terminates in a sharp point 13 that permits the rod to be forced through the fabric 14 of a garment such as a dress shirt or the like. A metal clasp 15 is equipped with a spring loaded detent ball 16 that is receivable in a groove 17 formed in the shank of the rod. In assembly, the clasp is forced over the distal end of the rod so that the detent ball is urged into the shank groove thus securing the unit in assembly.

It should be evident from FIG. 1 that forcing the rod through the fabric can damage the fabric and thus shorten the usable life of the garment. Because the button is not sewn to the rod, there is no stitching showing on the surface of the button, thereby giving the button an unnatural appearance. The pointed end of the rod is also exposed posing an annoyance or even a danger to the wearer. Lastly, the rod and clasp arrangement is relatively expensive to manufacture, making the price of a replacement unit relatively high.

Figure 2:
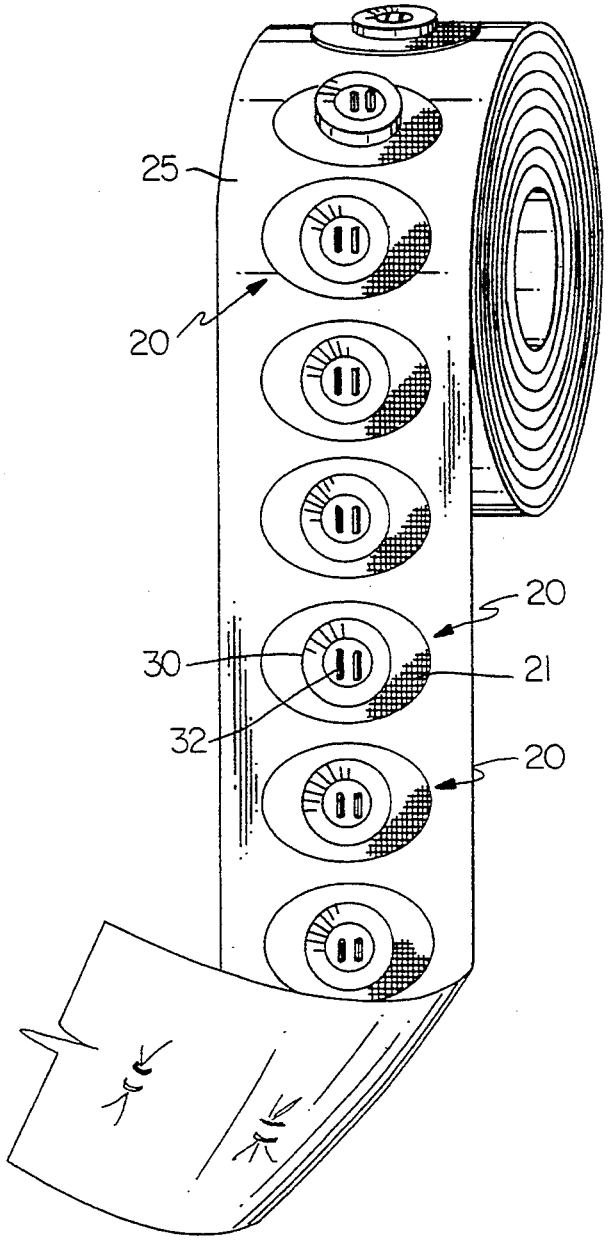
FIG. 2 is a perspective view showing a strip containing a plurality of replacement buttons embodying the teachings of the present invention.
Figure 4:
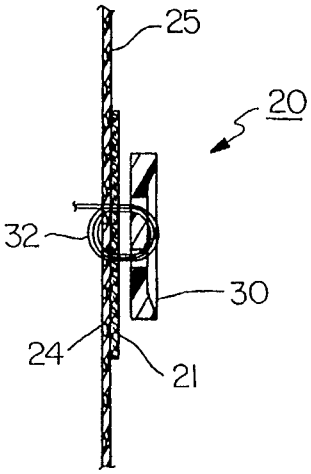
FIG. 4 is an enlarged partial side elevation illustrating a replacement button embodying the teachings of the present invention.
Figure 3:
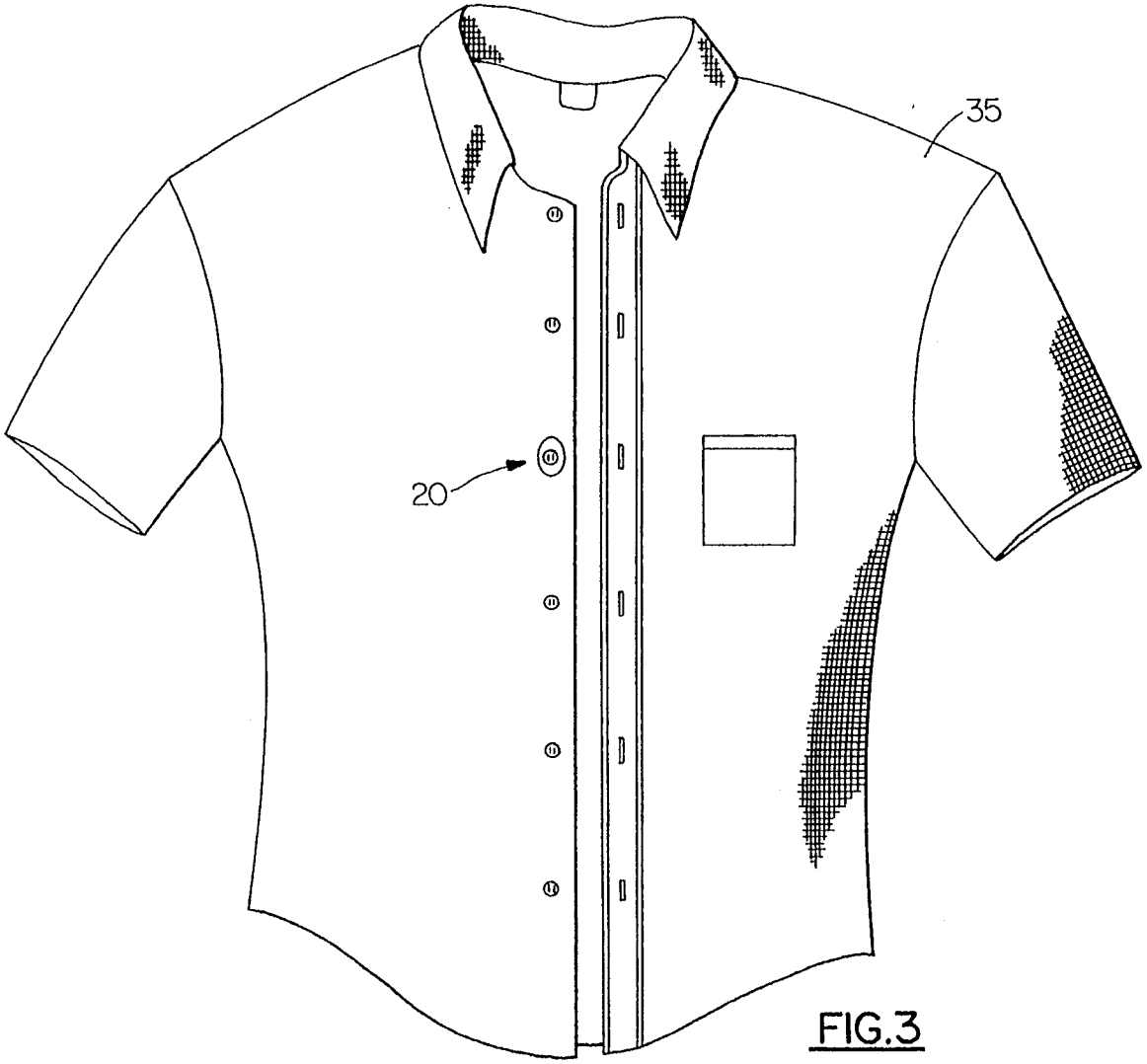
FIG. 3 is a front elevation illustrating the replacement button of the present invention applied to a garment.

FIG. 2 depicts a series of button units 20—20 embodying the teachings of the present invention releasably mounted upon a single backing sheet 25. The sheet can be wound upon itself for ease of storage and the individual units are simply removed from the roll by tearing the strip between units. With further reference to FIGS. 3 and 4, each replacement button unit 20 includes a fabric section 21. A two sided adhesive tape 24 is applied to the back face of the fabric section and trinuned to complement the shape of the fabric section. The fabric section is shown in the drawing to be oval-shaped, however, it should be clear to one skilled in the art that the geometry of the fabric section may take any form without departing from the teachings of the present invention.

The adhesive tape may be selected from any one of a number of commercially available products presently on the market. It has been found that a two sided tape marketed by Minnesota Metal and Mining Company under the product number 950 provides excellent bonding properties when applied to fabrics. This particular tape continues to maintain its bond strength even after the fabric has been subjected to a number of wash cycles in an automatic washing machine.

The exposed face of the adhesive tape is applied to a release sheet 25 from which the tape can be easily removed from the sheet without degrading the adhesive bonding properties of the tape. The release sheet is preferably formed of a paper substrate that is coated with a suitable release material, the reason for which will be apparent from the disclosure below.

A conventional button 30, as for example a four hole, ⅜ inch diameter dress shirt button, is centered upon the front face of the fabric section and the button is sewn to both the fabric section and the backing sheet using standard button stitching by means of an automatic sewing machine. As in the case of a permanent button, the threads 32 at the button holes are smooth and unbroken while the threads are tied off at the back of the releasable backing strip. This enhances the ability of the button unit to remain secured to the backing strip during handling and shipping and further provides for ease of manufacture.

To apply a replacement button unit 20 to a garment such as the dress shirt 35 illustrated in FIG. 3, the button unit is simply torn from the backing strip and the backing strip then peeled from the adhesive tape to expose the back of the tape. During the peeling operation the backing strip is easily torn away from the stitching. The exposed adhesive side of the button unit is then applied to the garment with the button being positioned over the site of a missing button. The size and shape of the fabric section allows the section to be positioned substantially beneath that portion of the garment containing the mating button hole. The replacement button is passed through the button hole to complete the closure of the garment. Preferably, the fabric section is formed of the same or similar material as the garment with the fabric section matching the pattern and color of the garment.

Figure 5:
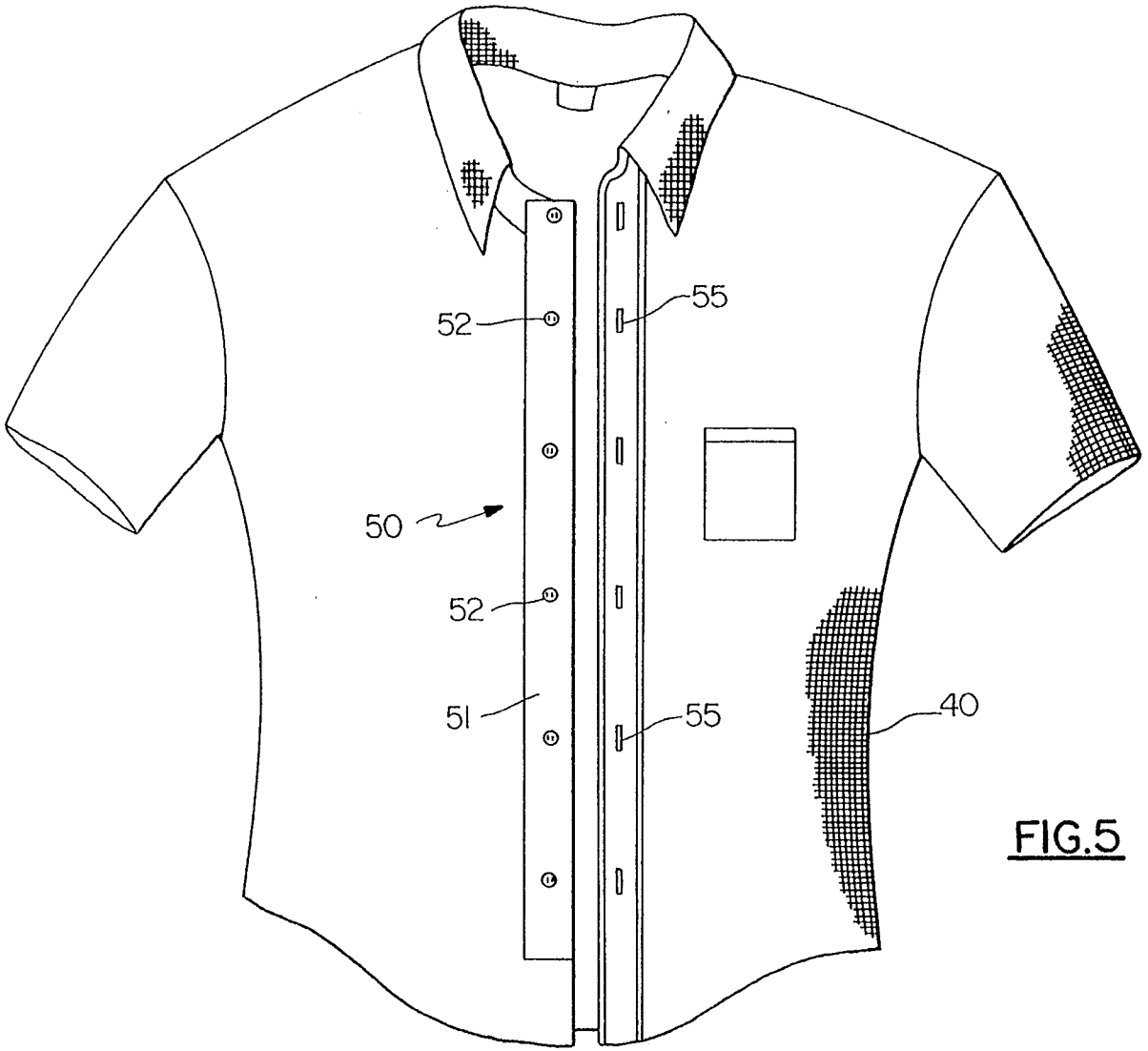
FIG. 5 is a front elevation of a garment showing a further embodiment of the present invention.

FIG. 5 involves a further embodiment of the invention wherein the garment 40 is a throw away piece of apparel which during the course of use will become contaminated and thus have to be discarded. In this embodiment, the fabric section of the unit is a long continuous strip 51 that has sewn thereon a series of vertically aligned buttons 52 that are spaced apart at desired intervals. The back of the sheet is provided with a two-sided adhesive tape along its entire length to which is applied a release backing sheet as described above. Here again, the buttons are sewn through both the fabric sections and the backing sheet.

The spacing of the buttons upon the strip 51 is equal to the spacing of the button holes 55—55 formed in the garment. In assembly, the backing sheet is peeled from the adhesive tape and the fabric section applied to the garment along the edge of the closure region with the buttons in registration with the button holes. As can be seen, the button unit of the present invention provides an inexpensive means for attaching buttons to a throw away garment which can be quickly and easily applied to the garment thereby realizing a further savings by eliminating a number of manufacturing steps.

While this invention has been explained with reference to the structure disclosed herein, it is not confined to the details set forth and this invention is intended to cover any modifications and changes as may come within the scope of the following claims:

What is claimed is:

1. A sew-free button assembly for use with an article of clothing, said assembly comprising:

a fabric section having a front face and a back face, an adhesive tape applied to the back face of said fabric section, a releasable backing sheet applied to said adhesive tape that can be peeled away from said adhesive tape to expose an adhesive surface on said fabric section, a button mounted on the front face of said fabric section and being attached to both said fabric section and the backing sheet by a common thread member whereby the thread member tears away from the backing sheet when the backing sheet is peeled away from said adhesive tape.

2. The assembly of claim 1 wherein said adhesive tape complements the shape of said fabric section.

3. The assembly of claim 2 wherein a plurality of fabric sections are mounted upon said backing sheet.

4. The assembly of claim 3 wherein said fabric sections are linearly disposed upon the backing sheet.

5. The assembly of claim 1 wherein said fabric section is made of the same type of material forming a preselected article of clothing.

6. The assembly of claim 1 wherein said fabric section is oval shaped and the button is centered upon the oval.

7. A sew free button assembly in association with a garment having a plurality of spaced apart button holes aligned along one edge of a garment closure provided on said garment, said assembly including:

a fabric section having a front face and a back face, an adhesive tape applied to the back face of said fabric section, a releasable backing sheet applied to the adhesive tape so that said fabric section can be removed from the backing sheet without degrading bonding properties of said adhesive tape, a series of buttons mounted in spaced apart alignment upon the front face of the fabric section, the button spacing being equal to that of button hole spacing formed in a preselected garment, each of said buttons being attached to both said fabric section and the backing sheet by a common thread member whereby the thread member tears away from the backing sheet as it is peeled from the fabric section.

8. The sew free button assembly of claim 7 wherein said garment is disposable.

* * * * *